US008672738B2

(12) United States Patent
Bozeman

(10) Patent No.: US 8,672,738 B2
(45) **Date of Patent: *Mar. 18, 2014**

(54) LOTTERY GAME HAVING ENHANCED WINNINGS

(75) Inventor: Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 1524 days.

This patent is subject to a terminal disclaimer.

(21) Appl. No.: 11/540,237

(22) Filed: Sep. 29, 2006

(65) Prior Publication Data

US 2007/0077982 A1 Apr. 5, 2007

Related U.S. Application Data

(60) Provisional application No. 60/722,826, filed on Sep. 30, 2005.

(51) Int. Cl.
*A63F 9/24* (2006.01)

(52) U.S. Cl.
USPC ..... 463/17; 463/16; 463/18; 463/19; 463/20; 273/138.1; 273/139; 273/269

(58) Field of Classification Search
USPC ..... 463/16–20; 273/269, 138.1, 139
See application file for complete search history.

(56) References Cited

U.S. PATENT DOCUMENTS

| | | | | |
|---|---|---|---|---|
| 5,613,679 | A | 3/1997 | Casa et al. | |
| 6,416,408 | B2 | 7/2002 | Tracy et al. | |
| 6,557,851 | B2 * | 5/2003 | Gauthier et al. | 273/139 |
| 6,648,753 | B1 | 11/2003 | Tracy et al. | |
| 6,692,354 | B2 | 2/2004 | Tracy et al. | |
| 6,969,318 | B1 | 11/2005 | Packes, Jr. et al. | |
| 7,347,776 | B2 * | 3/2008 | Wright | 463/17 |
| 7,513,825 | B2 | 4/2009 | Packes, Jr. et al. | |
| 7,641,548 | B2 | 1/2010 | Packes, Jr. et al. | |
| 7,662,038 | B2 | 2/2010 | Bozeman | |
| 2003/0060261 | A1 | 3/2003 | Katz et al. | |

(Continued)

FOREIGN PATENT DOCUMENTS

WO WO 01/74460 * 10/2001

OTHER PUBLICATIONS

"Powerball Odd & Prizes", & "How to play" Dated Dec. 2002 (www.powerball.com/powerball/pb_prizes.asp).*
PCT/US06/00580 Written Opinion and Search Report Aug. 24, 2007.

(Continued)

*Primary Examiner* — David L Lewis
*Assistant Examiner* — Chase Leichliter
(74) *Attorney, Agent, or Firm* — Dority & Manning, P.A.

(57) ABSTRACT

A multi-matrix lottery game allowing cross-matching between two sets of player indicia against two sets of game indicia drawn by a lottery authority is provided. A player selects one set of indicia from a first set of indicia matrix and another set of indicia from a second set of indicia matrix. The lottery authority determines an winning result by making similar selection from two sets of indicia matrices. The player's prize is determined by matching between indicia from the corresponding sets. The player is entitled to an enhanced prize if there is cross-matching between the player indicia from the first set and the winning indicia from the second set or between the player indicia of the second set and the winning indicia from the first set.

10 Claims, 6 Drawing Sheets

(56) References Cited

U.S. PATENT DOCUMENTS

| | | | | |
|---|---|---|---|---|
| 2003/0114210 | A1 | 6/2003 | Meyer et al. | |
| 2004/0166926 | A1 | 8/2004 | Adachi et al. | |
| 2004/0173965 | A1* | 9/2004 | Stanek | 273/269 |
| 2005/0003884 | A1* | 1/2005 | Meyer et al. | 463/17 |
| 2005/0014552 | A1 | 1/2005 | Packes, Jr. et al. | |
| 2005/0064930 | A1* | 3/2005 | Jubinville et al. | 463/17 |
| 2006/0217181 | A1* | 9/2006 | Jubinville et al. | 463/17 |
| 2006/0246995 | A1 | 11/2006 | Packes, Jr. et al. | |
| 2008/0300041 | A1* | 12/2008 | Strutt et al. | 463/17 |

OTHER PUBLICATIONS www.oregonlottery.org—Oregon Lottery, Oregon's Game Megabucks, Dec. 12, 1998.

Maryland State Lottery—Keno Bonus Animation, Dec. 12, 1998.

Article—Georgia Powerball, Confusion or Cash Awaits Game Players, The Atlanta Journal and The Atlanta Constitution, Sep. 2, 1995.

Article—Powerball Winners Could Double Prizes, Catoosa County News, Sep. 6, 1995.

* cited by examiner

| Regular | Special | Prize | Probability (per play) |
|---|---|---|---|
| 4 | 1 | Jackpot | 1 in 975,415.0 |
| 4 | 0 | $2,500 | 1 in 32,513.8 |
| 3 | 1 | $20 | 1 in 9,031.6 |
| 3 | 0 | $5 | 1 in 301.1 |
| 2 | 1 | $3 | 1 in 463.2 |
| 2 | 0 | $2 | 1 in 15.4 |

| Cross Matches | Multiplier | 1/Probability (per play) |
|---|---|---|
| 2 | 10 | 60.1 |
| 1 | 2 | 4.4 |

| Prize | Probability (per ticket) |
|---|---|
| Jackpot | 1 in 487,707.5 |
| $25,000 or more (avg. $25,000) | 1 in 325,138.3 |
| $5,000 to $24,999 (avg. $5,000) | 1 in 31,465.1 |
| $2,500 to $4,999 (avg. $2,500) | 1 in 37,517.2 |
| $200 to $2,499 (avg. $200) | 1 in 12,042.5 |
| $50 to $199 (avg. $50) | 1 in 3,727.6 |
| $20 to $49 (avg. $22) | 1 in 196.6 |
| $2 to $19 (avg. $3) | 1 in 7.7 |

| Cross Matches | Multiplier | 1/Probability (per play) |
|---|---|---|
| 2 | 20 | 60.1 |
| 1 | 2 | 4.4 |

LOTTERY GAME HAVING ENHANCED WINNINGS

CROSS-REFERENCE TO RELATED APPLICATION

This application claims the benefit of the U.S. Provisional Patent Application No. 60/722,826, "Lottery Game Having Enhanced Winnings With Predefined Threshold," filed on Sep. 30, 2005, the specification of which is incorporated in its entirety herein by this reference.

BACKGROUND OF THE INVENTION

1. Field of the Invention

The present invention relates to lottery games and more specifically to a lottery game in which multiple entries on a single ticket provides cross-matching possibilities with enhanced winnings.

2. Description of the Related Art

Lottery games that use multiple matrices are well-known, one such example being the "MEGA MILLIONS," in which a player chooses five (5) numbers from 1 to 56 and chooses one (1) MEGA BALL number from 1 to 46. The first set of five numbers is chosen from a first set of numbers that is independent from the second set of numbers where the MEGA BALL is chosen. The player numbers are then compared with the numbers drawn by the lottery authority. The player's five numbers are matched against the five numbers selected by the lottery authority and the player's MEGA BALL number is matched against the official MEGA BALL number. The prize is based on the result of the comparison.

There is no "cross-matching" between two sets of numbers, i.e., there is no special prize if a player's number in the first set of five numbers matches the official MEGA BALL number. Similarly, there is no prize for a player's MEGA BALL number matching one of the five numbers selected by the lottery authority. Consequently, the chance of winning is not substantially increased when a player purchases multiple game entries in one single drawing and the prize is similarly not affected by the multiple game entries. Therefore, it is desirable to have a lottery game in which the chance of winning and the prize are increased by multiple game entries, and it is to such lottery game the present invention is primarily directed.

SUMMARY OF THE INVENTION

In one embodiment, there is provided a method for playing a lottery game with enhanced winnings. The method includes the steps of a) receiving a first set of regular player indicia, b) receiving a first special player indicia, c) generating a first set of regular game indicia, d) generating a first special game indicia, e) comparing the first set of regular player indicia with the first set of regular game indicia, f) comparing the first special player indicia with the first special game indicia, g) determining a prize based on comparison results from steps e) and f), h) comparing the first set of regular player indicia with the first special game indicia, i) comparing the first set of regular game indicia with the first special player indicia, j) determining a multiplier based on comparison results from step h) and i), and k) determined a payout based on the prize and the multiplier. The present invention therefore provides an advantage in that chances of winning are increases with cross-matching and prizes are enhanced with multipliers.

Additional features and advantages of the invention will be readily apparent from the following detailed description and appended claims when taken in conjunction with the accompanying drawings.

DETAILED DESCRIPTION OF THE INVENTION

Briefly described the present application discloses a multi-matrix lottery game that allows cross-matching of player indicia against the game indicia drawn by a lottery authority and the cross-matching provides additional winning possibilities and enhances the winning prizes. A "cross-match" is defined as a match between a player's number (player indicia) with regard to one matrix and a lottery's selection (game indicia) with regard to a different matrix.

In one embodiment the game is based on two matrices with different parameters: the $1^{st}$ matrix's parameters are 4/4/31 and the $2^{nd}$ matrix's parameters are 1/1/31. For convenience, we refer to the $1^{st}$ matrix as "regular" and the $2^{nd}$ matrix as "special" (e.g., each play and draw is composed of 4 "regular" numbers and 1 "special" number). Also, plays are distinguished by types: "Type A" and "Type B." For a Type A play, the special number does not repeat any of the regular numbers (e.g., regular numbers: 01, 02, 03, 04, special number: 05). For a Type B play, the special number repeats one of the regular numbers (e.g., regular numbers: 01, 02, 03, 04, special number: 03, the special number repeats a regular number). This game without (or before) consideration of the cross-matches is referred to as the "base game."

Figure 1:
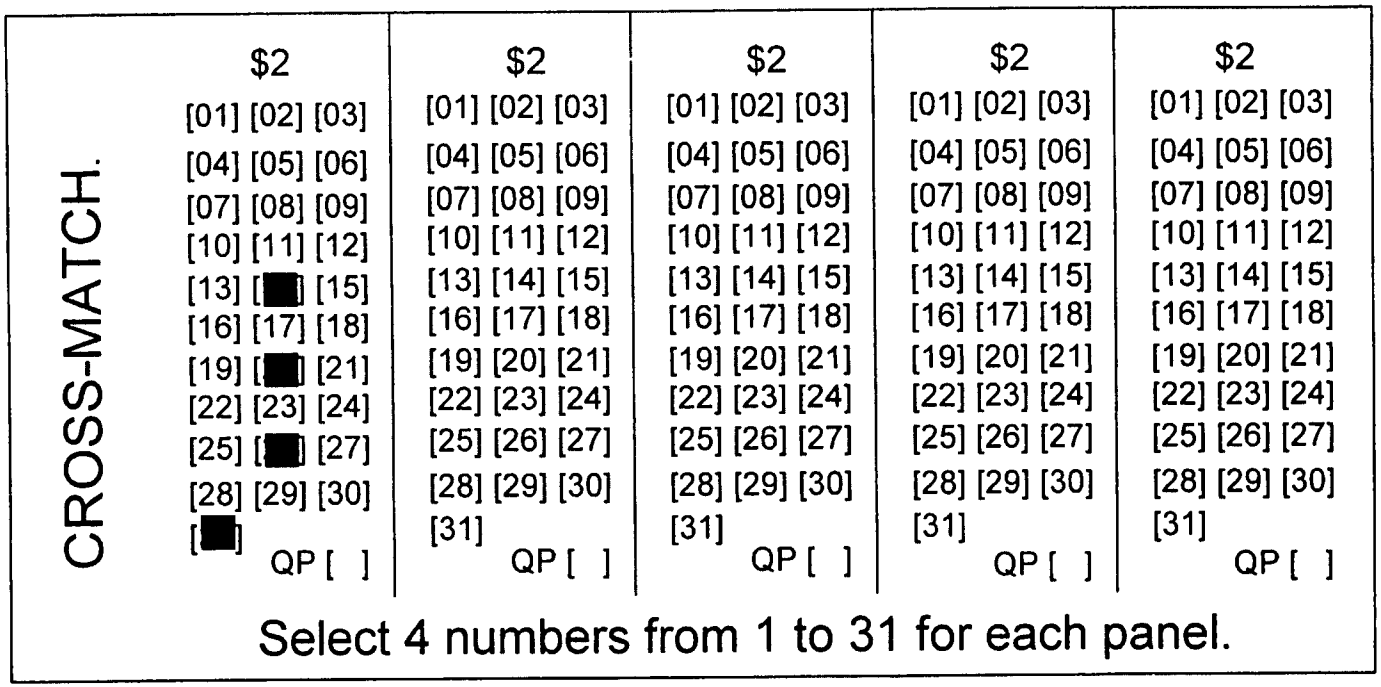
FIG. 1 is an exemplary playslip for one embodiment of a game.

An exemplary playslip is in FIG. 1. The player may choose the 4 regular numbers for his $1^{st}$ play. The player selects the 4 regular numbers by marking a panel. Alternatively, the regular numbers may be generated automatically by a random number generator through a "quick-pick" (QP) selection. In this example, the player has marked numbers 14, 20, 26, and 31, which will comprise the regular numbers for his $1^{st}$ play. The special number for the first play and the entire $2^{nd}$ play will be assigned by the lottery in one embodiment. In an alternative embodiment, the player may be able to choose also the special number for the first play as well as the numbers for the second play.

Figures 2, 3, 4, 5:
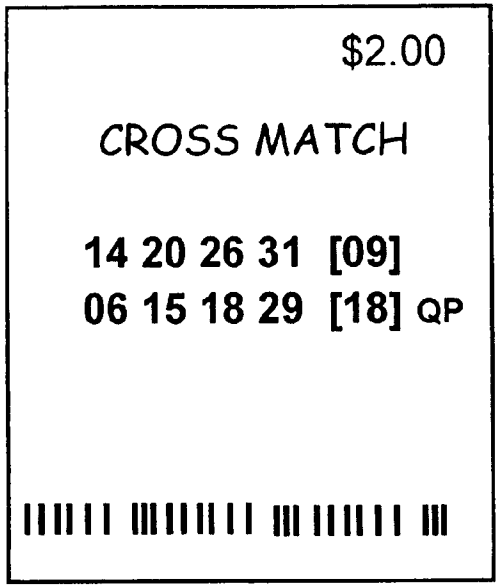
FIG. 2 is a corresponding lottery ticket for the playslip of FIG. 1
FIG. 3 is an exemplary prize table according to one embodiment of the invention.
FIG. 4 is an exemplary multiplier table according to one embodiment of the invention.
FIG. 5 is an exemplary prize table.

An exemplary corresponding ticket is in FIG. 2. The $1^{st}$ play is required to be of Type A. The regular numbers for the 1st play are 14, 20, 26, 31, (as marked by the player on the playslip), and the special number is 09 (randomly assigned by the lottery subject to being distinct from the 4 regular numbers). The 2nd play is required to be of Type B. The regular numbers are 06, 15, 18, 29, (randomly assigned by the lottery) and the special number is 18 (randomly selected from among the 4 regular numbers). In an alternative embodiment, the first play can also be Type B and the second play can also be Type A.

The top prize is a progressive, pari-mutuel jackpot that starts at $50,000 and increments a minimum of $5,000 per draw. The jackpot is won by matching the 4 regular numbers and the 1 special number with the lottery draw. 20.0% of the sales are reserved for the jackpot. (A certain level of sales is required to support this jackpot scheme, e.g., $50,000 sales per draw is sufficient.)

Prizes for the lower tiers and their associated inverse probabilities are described in FIG. 3. In addition to these prizes, multipliers are awarded for "cross-matches." A cross-match occurs when one of a play's regular numbers matches the lottery's special number, or, when one of the lottery's regular numbers matches a play's special number. It is possible for single play to attain 0, 1 or 2 cross-matches. As indicated in FIG. 4, a play is awarded a 2 multiplier for 1 cross-match and a 10 multiplier for 2 cross-matches. This multiplier applies only to lower-tier prizes, not the jackpot. FIG. 5 is a composite prize table that consolidates the prize table in FIG. 3 and the multiplier table in FIG. 4. Following are two sample games. Numbers that match in the base game are circled and cross-matches are surrounded by a square.

Example 1

Figure 6:
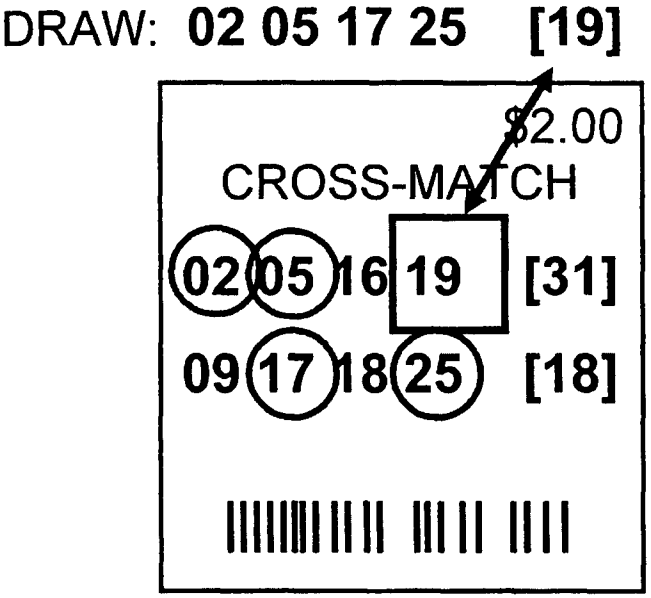
FIG. 6 depicts a lottery ticket according to one embodiment of the invention.

The lottery draws 02, 05, 17, and 25 for the regular numbers and 19 for the special number. The player's ticket is shown in FIG. 6. It comprises two plays: (1st play) regular numbers: 02, 05, 16, 19, and special number: 31, and (2nd play) regular numbers: 09, 17, 18, and 25, and special number: 18. Note that the 1st play is Type A and the 2nd is Type B as required.

For the 1st play, 2 regular numbers (02 and 05) match 2 of the lottery's regular numbers. The special number for the 1st play, 31, does not match the lottery's special number, 19. As the player's outcome is 2 regular matches and 0 special matches he is awarded $2 by the prize table in FIG. 3. Also, the 1st play has 1 cross-match as one of the regular numbers, 19, matches the lottery's special number. By the table in FIG. 4, the player is awarded a 2 multiplier. The winnings for the first play are 2×$2=$4.

For the 2nd play, 2 regular numbers (17 and 25), match 2 of the lottery's regular numbers. Also, the special number (18) does not match the lottery's special number (19). As the player's outcome is 2 regular matches and 0 special matches he is awarded $2 by the prize table in FIG. 3. However, there are no cross-matches as neither any of the player's regular numbers match the lottery's special number, nor does the player's special number match any of the lottery's regular numbers. The prize for the 2nd play is $2. The total prize for this ticket is $4 (1st play)+$2 (2nd play)=$6.

Example 2

Figure 7:
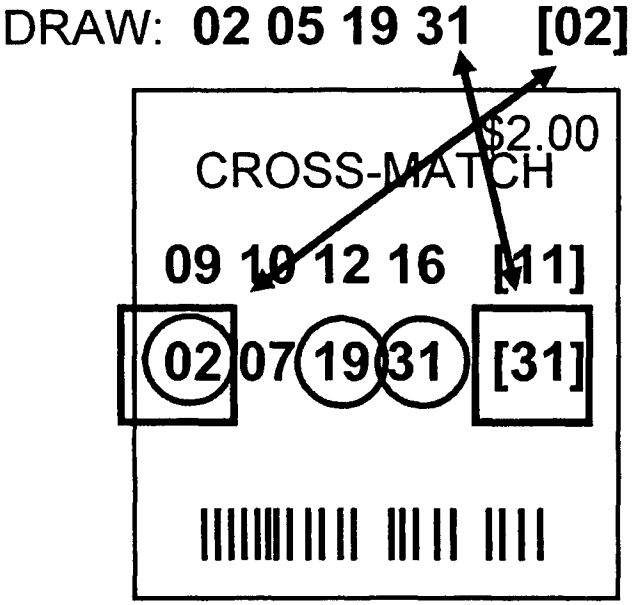
FIG. 7 depicts another lottery ticket with cross-matching according to one embodiment of the invention.

The lottery draws 02, 05, 19, and 31 for the regular numbers and 02 as the special number. The player's ticket is as in FIG. 7. It comprises two plays: (1st play) regular numbers: 09, 10, 12, and 16, and special number: 11, (2nd play) regular numbers: 02, 07, 19, and 31, and special number: 31. Note that the 1st play is Type A and the 2nd is Type B.

For the 1st play, none of the player's regular numbers match any of the lottery's regular numbers. Nor does the player's special number (11) match the lottery's special number, 02. Nor are there any cross-matches. This play does not win a prize for the 1st play:

For the 2nd play, 3 of the regular numbers (02, 19 and 31) match 3 of the lottery's regular numbers. The special number (31) does not match the lottery's special number (02). As the player's outcome is 3 regular matches and 0 special matches he is awarded $5 by the prize table in FIG. 10. Also, the play has two cross-matches: (1) one of the regular numbers, (02), matches the lottery's special number, and the special number, (31), matches one of the lottery's regular numbers. Notice that 02 is both circled and surrounded by a square as it is both a match in the base game and a cross-match. The play is awarded a 10 multiplier for 2 cross-matches by the table in FIG. 4. The prize for the 2nd play is 10×$5=$50. The total prize for this ticket is $0 (1st play)+$50 (2nd play)=$50.

Those skilled in the art of Mathematics can confirm that this embodiment pays out 62.3% (which includes 20.0% for the jackpot) and has an overall win rate of 1 in 7.4. It should be noted that this game exhibits short term volatility. The lottery's special number repeats one of its regular numbers about 1 in 7.75 draws. When this happens, the payout is on average 111.5%, vs. 55.0% for other draws.

Another variation on this embodiment is to incorporate set prizes based on cross-matches. For example, in the above embodiment, the prize for 2 cross-matches could be revised to be the greater of $5 and the multiplier (i.e., whatever value is obtained by applying the multiplier, which could be $0). This enhancement would increase the overall win frequency to 1 in 6.2 (as opposed to 1 in 7.4) and the payout to 69.3% (as opposed to 62.3%).

To elaborate on design details, it is recalled that in the above embodiment it is required that the two plays be of different types: Type A and Type B. This is done so that the value of a ticket is uniform. This discourages retailer theft as all tickets are of equal value. It also allows tickets to be non-cancelable as no ticket has an advantage over another.

It is recalled that in the above embodiment the player is allowed to select the regular numbers for the 1st play (e.g. on the playslip in FIG. 8), but he is not allowed to select any numbers for the 2nd play. This is not absolutely necessary, but it may be prudent. The 2nd play (Type B) is more volatile than the 1st play. For example, a large lower-tier prize of $25,000 is possible for the 2nd play but not the 1st play. Therefore, if a popular set of regular numbers is drawn (e.g., 01, 02, 03, and 04), it will not affect prizes for the 2nd play and create an unmanageable number of $25,000 prize winners.

Figures 8, 9:
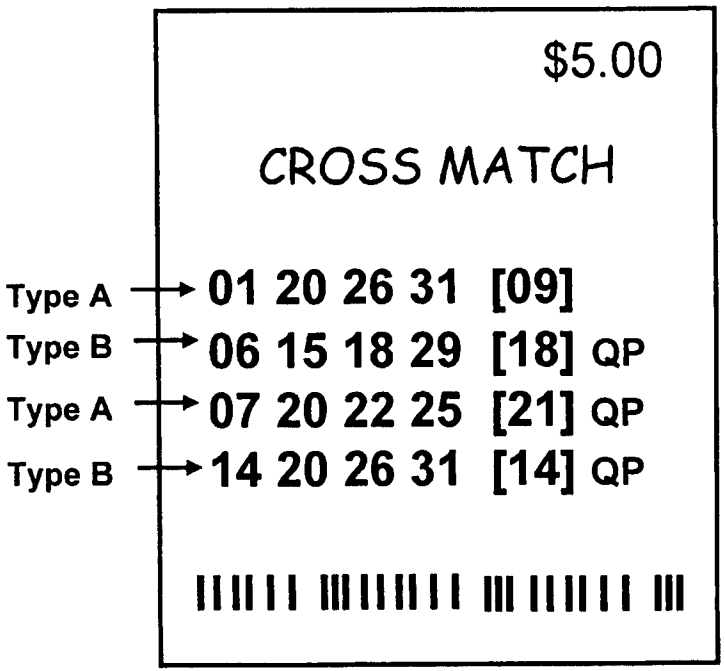
FIG. 8 is another exemplary multiplier table according to one embodiment of the invention.
FIG. 9 depicts a lottery ticket with multiple entries according to one embodiment of the invention.

An alternative embodiment is described that is conceived to be an enhancement for a higher price. It may be run concurrently with the first embodiment described above using the same draw. In this alternative embodiment, the player pay $5 for 4 plays. The base game prize table is the same as for the first embodiment, in FIG. 3, except the multiplier associated with 2 cross-matches has been enhanced. It is 20 as opposed to 10 for the first embodiment, as indicated in FIG. 8. An exemplary ticket is in FIG. 9. It is required that there be two "Type A" plays and two "Type B" plays. An enticement for playing this $5 game verses the $2 version is that the player has an opportunity for a $50,000 prize, as opposed to $25,000. For example, if a player win $2,500 in the base game and 2 cross-matches, he wins 20×$2,500=$50,000 as opposed to 10×$2,500=$25,000. Those skilled in the art of Mathematics can confirm that the return for this embodiment is 58.5%

(which includes 16.0% for the jackpot) and that the overall probability of winning a prize is 1 in 3.9.

Figure 10:
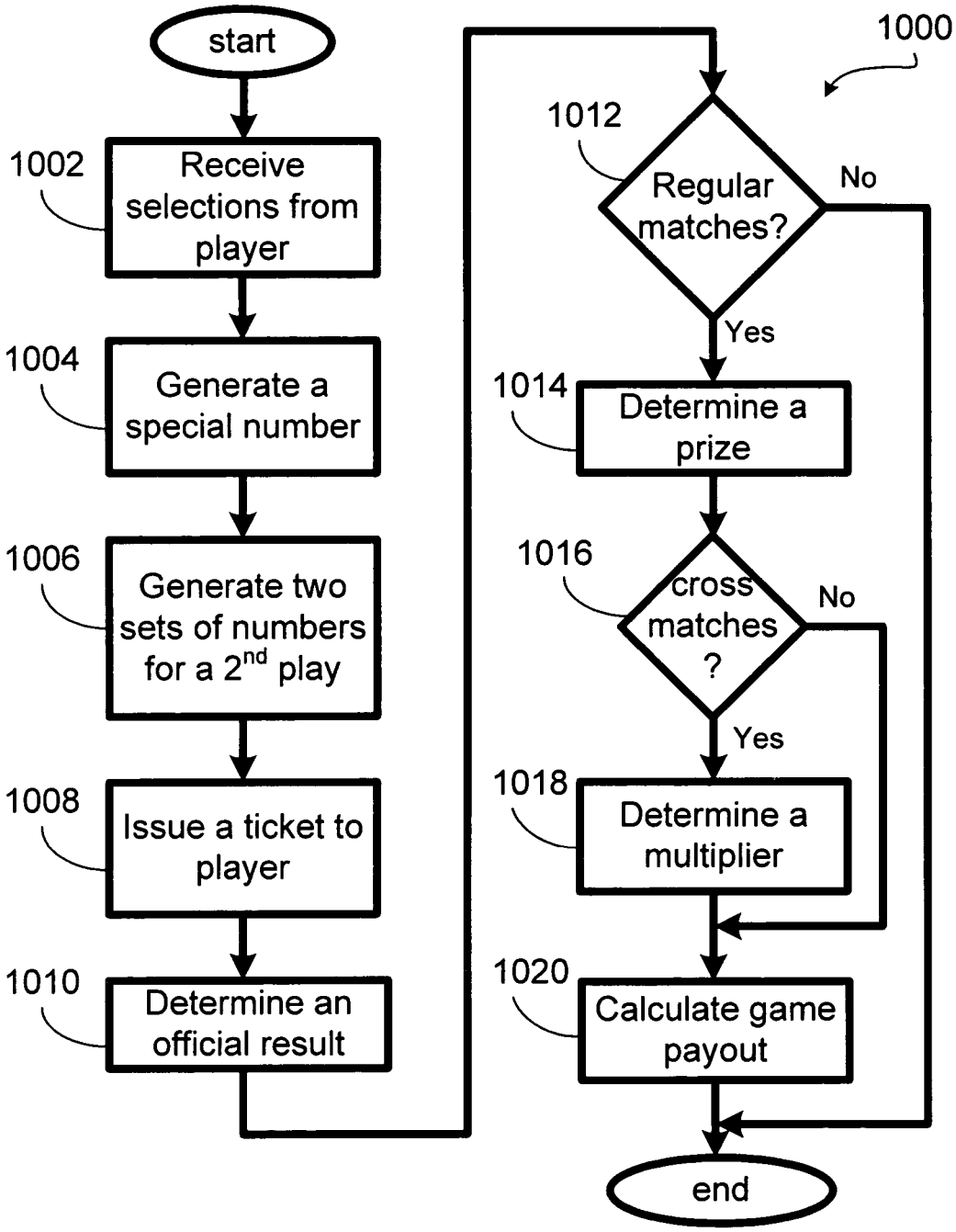
FIG. 10 is a lottery game process according to one embodiment of the invention.

FIG. 10 illustrates a process for playing a lottery game according to one embodiment of the invention. The player buys a lottery game ticket and chooses his numbers through a playslip at a lottery game station. The player's numbers are received by the lottery game station, step 1002, and the lottery game station will generate a special number, step 1004. The lottery game station will also generate numbers for the second play, step 1006, and issue a ticket to the player, step 1008. The player's numbers are then sent to a centralized server. The lottery authority will determine an official set of winning numbers, step 1010. After the official winning numbers are determined, the lottery authority will check for winners by first determining if there is any match between the official regular numbers and player's regular numbers and if there is any match between the official special number and the player's special number, step 1012. If there is no match, the player lost. If there are matching numbers, the lottery authority will check if the matching numbers entitle the player to a prize, step 1014. If the player is entitled to a prize, the lottery authority then checks if there is any cross-match between the official numbers and the player's numbers, step 1016. If there is no cross-match, then the player is entitled only to his regular prize, step 1020. If there is cross-match, then a multiplier is determined, step 1018, and the player's regular payout will be enhanced by the multiplier, step 1020.

Figure 11:
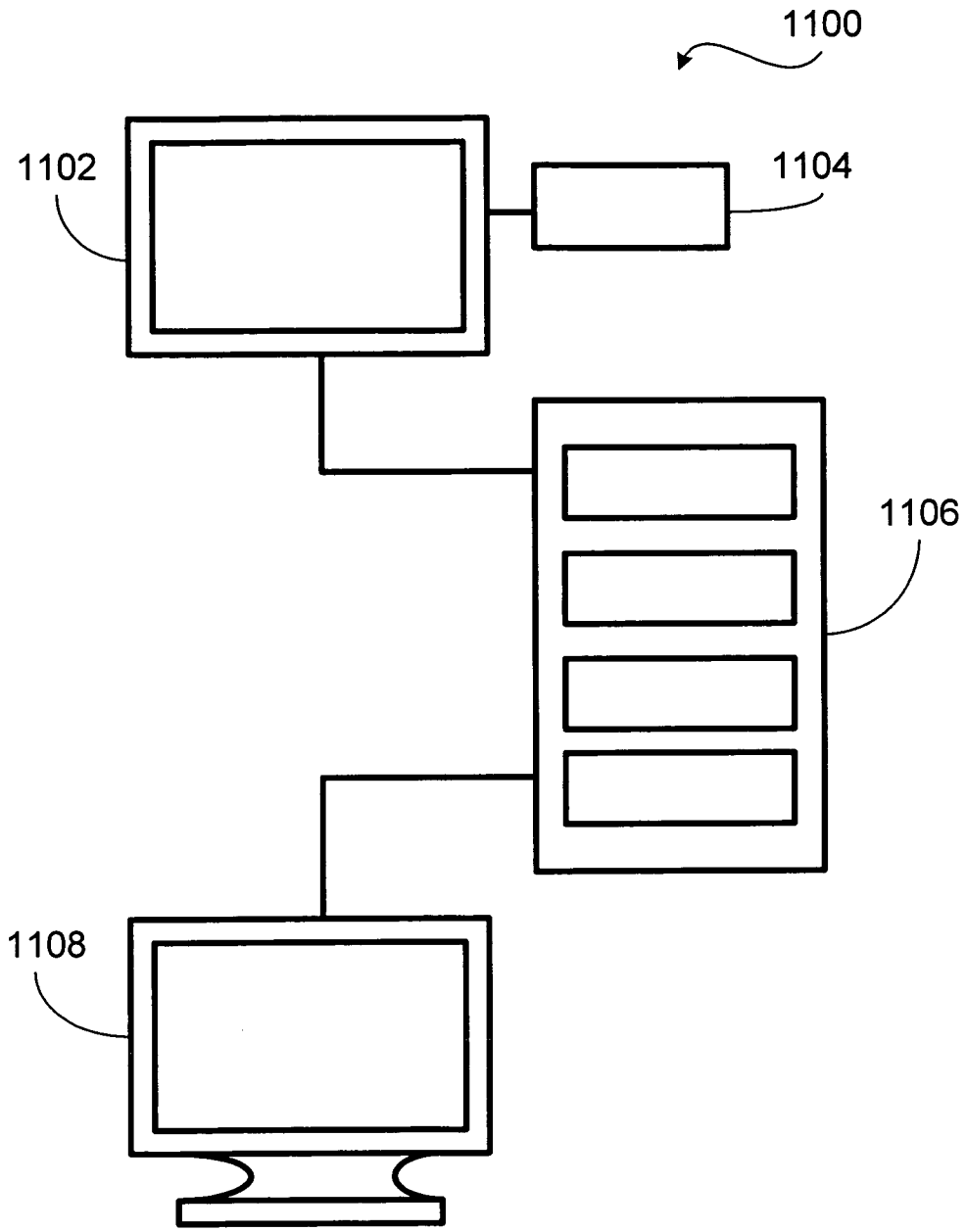
FIG. 11 is depicts a system supporting the present invention.

FIG. 11 illustrates a system 1100 according to the invention. The game of the invention can be played through a display device 1102. The display device 1102 may be a touch screen device capable of receiving user selection. Alternatively, the display device 1102 may also be equipped with a game input device (not shown) such as keyboard or game device through which a player may enter his selection. The display device 1102 may also be equipped with a scanning input device capable of receiving the user selection recorded in a play slip. The display device 1102 may be equipped with a device 1104 that takes wager from the player. The wager may be in form of credit card or cash. The display device 1102 is connected to a game server 1106. The server 1106 includes a controller that is capable of generating game symbols (game indicia) for the lottery authority and determine number of matches between the game symbols and player symbols. The server 1106 may also includes a storage unit for storing game entries received from the players and the multiplier and game payout tables. Alternatively, the game may be played through a remote terminal 1108 connected to the server 1106. The remote terminal 1108 may be a computing device located in a casino and may also be a computing device located in a player's home.

Although preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms are employed herein, they are used in a generic and descriptive sense only, and not for the purposes of limiting the described invention.

What is claimed is:

1. A method for playing a lottery game with enhanced winnings, comprising the steps of:

a) receiving a first set of regular player indicia designated by a player via an input means to a game server;

b) receiving at least one first special player indicia designated by the player via the input means to the game server, wherein the first special player indicia is designated separately from the regular player indicia and is distinct from and considered separately of the regular player indicia;

c) generating a first set of regular game indicia with the game server and displaying the first set of regular game indicia to the player;

d) generating at least one first special game indicia with the game server and displaying the first special game indicia to the player, wherein the first special game indicia is generated separately from the regular game indicia and is distinct from and considered separately of the regular player indicia;

e) with the game server, comparing only the complete first set of regular player indicia with only the complete first set of regular game indicia;

f) with the game server, comparing the first special player indicia with the first special game indicia;

g) determining a prize based on comparison results from steps e) and f);

h) with the game server, comparing the complete first set of regular player indicia with the first special game indicia;

i) with the game server, comparing the complete first set of regular game indicia with the first special player indicia;

j) with the game server, determining a multiplier based on comparison results from step h) and i); and k) with the game server, determining a payout based upon the prize and the multiplier.

2. The method of claim 1, wherein the first set of regular player indicia is generated automatically as an option for the player by the game server.

3. The method of claim 1, wherein the first set of regular player indicia is selected manually by a player via the input means.

4. The method of claim 1, further comprising the steps of:

l) receiving a second set of regular player indicia; and m) receiving a second special player indicia; and repeating steps e) through k) based on comparison of the second set of regular player indicia with the first set of regular game indicia, and comparison of the second special player indicia with the first special game indicia, and comparison of the first special game indicia with the second set of regular player indicia.

5. A gaming server for hosting a lottery game with enhanced winnings, the gaming server comprising:

a game input device for receiving a game entry with a first set of player indicia;

a storage unit for storing a prize table and a multiplier table; and a controller being capable of a) receiving the first set of regular player indicia;

b) receiving at least one first special player indicia, wherein the first special player indicia is selected separately from the regular player indicia and is distinct from and considered separately of the regular player indicia;

c) generating a first set of regular game indicia;

d) generating at least one first special game indicia, wherein the first special game indicia is selected separately from the regular game indicia and is distinct from and considered separately of the regular player indicia;

e) comparing only the complete first set of regular player indicia with only the complete first set of regular game indicia;

f) comparing the first special player indicia with the first special game indicia;

g) determining a prize based on comparison results from steps e) and f);

h) comparing the complete first set of regular player indicia with the first special game indicia;

i) comparing the complete first set of regular game indicia with the first special player indicia;

j) determining a multiplier based on comparison results from step h) and i); and k) determining a payout based on the prize and the multiplier.

6. The gaming server of claim 5, wherein the controller further being capable of:

l) receiving a second set of regular player indicia; and m) receiving a second special player indicia; and repeating steps e) through k) based on comparison of the second set of regular player indicia with the first set of regular game indicia, and comparison of the second special player indicia with the first special game indicia, and comparison of the first special game indicia with the second set of regular player indicia.

7. A non-transitory computer-readable medium on which is stored a computer program for playing a lottery game with enhanced winnings, the computer program comprising computer instructions that when executed by a computer performs the steps of:

a) receiving a first set of regular player indicia;

b) receiving at least one first special player indicia, wherein the first special player indicia is designated separately from the regular player indicia and is considered separately from the regular player indicia;

c) generating a first set of regular game indicia;

d) generating at least one first special game indicia, wherein the first special game indicia is selected separately from the first set of regular game indicia and is considered separately from the first set of regular player indicia;

e) comparing only the complete first set of regular player indicia with only the complete first set of regular game indicia;

f) comparing the first special player indicia with the first special game indicia;

g) determining a prize based on comparison results from steps e) and f);

h) comparing the complete first set of regular player indicia with the first special game indicia;

i) comparing the complete first set of regular game indicia with the first special player indicia;

j) determining a multiplier based on comparison results from step h) and i); and k) determining a payout based on the prize and the multiplier.

8. The non-transitory computer-readable medium of claim 7, wherein the first set of regular player indicia being generated automatically.

9. The non-transitory computer-readable medium of claim 7, wherein the first set of regular player indicia being selected manually by a player.

10. The non-transitory computer-readable medium of claim 7, wherein the computer program further performing the steps of:

l) receiving a second set of regular player indicia; and m) receiving a second special player indicia; and repeating steps e) through k) based on comparison of the second set of regular player indicia with the first set of regular game indicia, and comparison of the second special player indicia with the first special game indicia, and comparison of the first special game indicia with the second set of regular player indicia.

* * * * *